US010612886B2

(12) United States Patent
Wang

(10) Patent No.: US 10,612,886 B2
(45) Date of Patent: Apr. 7, 2020

(54) SLIDING REVOLVER PISTOL

(71) Applicant: Shidong Wang, Plano, TX (US)

(72) Inventor: Shidong Wang, Plano, TX (US)

( * ) Notice: Subject to any disclaimer, the term of this patent is extended or adjusted under 35 U.S.C. 154(b) by 25 days.

(21) Appl. No.: 15/932,430

(22) Filed: Jul. 3, 2017

(65) Prior Publication Data

US 2019/0003800 A1 Jan. 3, 2019

(51) Int. Cl.
*F41A 25/12* (2006.01)
*F41C 3/14* (2006.01)
*F41A 3/78* (2006.01)

(52) U.S. Cl.
CPC ..... *F41C 3/14* (2013.01); *F41A 3/78* (2013.01); *F41A 25/12* (2013.01)

(58) Field of Classification Search
CPC ..... F41C 3/14; F41A 25/12
USPC ..... 42/1.06, 59, 155
See application file for complete search history.

(56) References Cited

U.S. PATENT DOCUMENTS 946,351 A 1/1910 Haeghen
3,055,270 A * 9/1962 Miller ..... F41A 5/02 89/157
3,537,204 A * 11/1970 Woloch ..... F41C 3/14 42/66
3,613,285 A * 10/1971 Kennedy ..... F41C 3/14 42/59

FOREIGN PATENT DOCUMENTS

GB 190918495 A * 2/1910 ..... F41A 9/49

* cited by examiner

*Primary Examiner* — Samir Abdosh

(57) ABSTRACT

The Sliding Revolver Pistol is a new design of revolver pistols which has less recoil and more accuracy. The main difference with traditional revolver pistols is that the new design lets the barrel and cylinder slide back together at firing time.

18 Claims, 5 Drawing Sheets

SLIDING REVOLVER PISTOL

BACKGROUND OF THE INVENTION

Semiautomatic pistols and revolver pistols are the most popular pistols on the market. The revolver pistols are popular handguns for carry, but it has strong recoil which causes hand pain and less accuracy. Semiautomatic pistols are popular home defense handguns, but often the bullet can get stuck or the machinery in the gun itself will get stuck if it is not maintained or when the user moves the slider too weakly. So in current market, there is no satisfactory carry handgun which is easy to use for carry or defense, especially for women. These are many situations where defense fails and causes sad results.

DETAILED DESCRIPTION OF THE INVENTION

Figure 1:
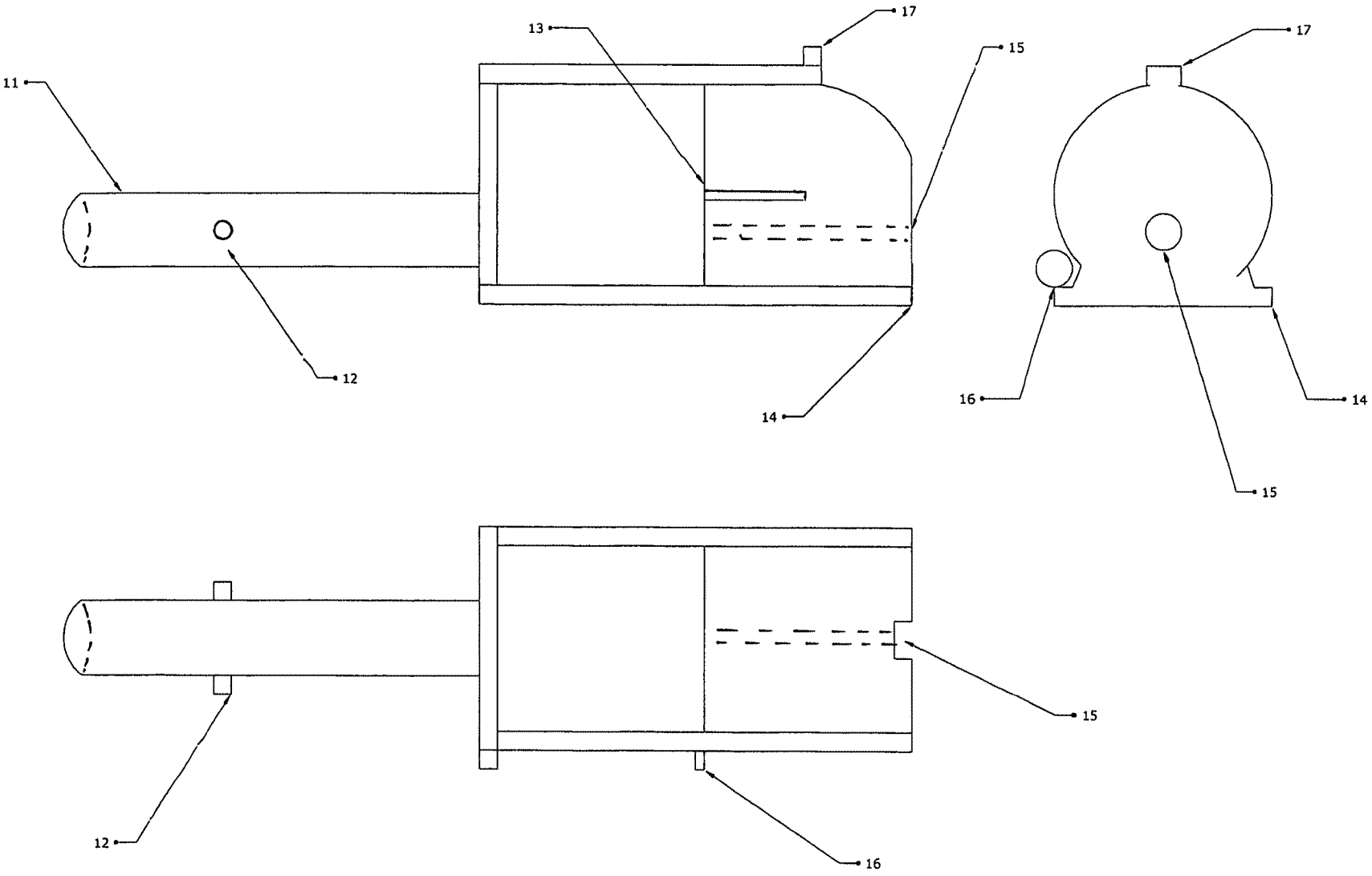
FIG. 1 shows a front view, a top view, and a side view of a part of a revolver pistol barrel in examples of the present disclosure.

The Sliding revolver pistol is a new concept of revolver pistols which has less recoil and more accuracy. The main difference with traditional revolver pistols is that the new design adds a barrel spring which lets the barrel and cylinder slide back together at firing time. The barrel is straight ahead of the cylinder bottom chamber not on top like in traditional revolver pistols. This new approach creates less recoil and more accuracy.

The new design lets the barrel and cylinder move as one entity which slides on the channel. The barrel spring has been designed to cover the barrel. The barrel spring is bigger than a traditional barrel spring which makes the spring function more effective. The barrel spring's rear side has been latched on to the pistol body which holds the barrel body on to the pistol body also. The barrel front side has a clutch that allows it to connect with the spring. During the firing time, the barrel's front side presses the spring back along with the channel, reducing the recoil.

The new design uses a hammer strike which makes the trigger have two actions. When the barrel and cylinder slide back, it pushes the hammer back and puts the trigger on the position for action two. For safety, action one should weigh 8 pounds and action two should weigh 4 pounds. This increases accuracy.

The cylinder can turn by the traditional way. Or you could design a cylinder shift tunnel which can turn the cylinder to the next position when the cylinder slides back.

The advantage for this gun is that there is a smaller chance for machinery to get stuck compared to semiautomatic pistols. Because it does not have magazine and lading steps, it is also very easy to maintain and less need to install and uninstall.

When using this gun do not fire too many rounds at once because it can cause the spring to heat up. Additionally, the sights may be too short between front sight and rear sight. However, for a carry on gun, this is not a very critical factor.

FIG. 1.

This is the part of the revolver pistol barrel which will hold the cylinder. The difference with traditional pistols is that it can be moved with the slider channel when shooting. [12] is the barrel spring clutch which can be used to pull the spring back to reduce the recoil. [14] is the Barrel slider channel which allows the barrel and cylinder body to slide back. The cylinder shoots bullets from the bottom chamber instead of the top one like a traditional revolver pistol. However, the cylinder can also shoot bullets from the top chamber if a proper trigger is designed on it. Additionally, the front and rear sights Page 2 of 3 can be added on top of the cylinder holder. The sight can also be added on the left side of the gun body for longer ranged aim.

FIG. 2.

This is the revolver pistol body which includes the handgrip, trigger and barrel holder. The pistol barrel has been covered by the other pipe [26] which is named as barrel slider semi-tunnel cover. The pistol barrel can slide inside of the [26]. The pipe consists of two half circle pipes, that is why it is called semi-tunnel. The semi-tunnel pipe allows the spring clutch to move forward and backward. [23] is the barrel spring latch which can hold the spring in place on the pistol body full time. [24] is the barrel slider channel which prevents the barrel body from moving in different directions. [27] is the barrel spring cover which makes up the front of the gun. Some holes can be added to [27] to add oil for maintenance and for air flow. Because the barrel is longer than the barrel holder, [21] is used to cover the front barrel.

[25] is called cylinder step shift window which allows the trigger [45] to touch the cylinder through it. This function makes the cylinder move to the next position for the next shot. In my design, the cylinder can still move like a traditional pistol. However, I have an alternative suggestion later in FIG. 4.

FIG. 3.

This is the barrel spring which is used to reduce recoil. This is the key point that distinguishes this pistol from traditional revolver pistols. [34] are the barrel spring latch tunnels. Latches are inserted into [34] fix the spring's back side to the pistol body. [36] are the barrel spring clutches. This is used to lock the spring's front when structure [12] on the barrel pulls the spring back during shooting. [35] are windows that allow [12] to pass so the spring can be installed. After [12] goes through [35], then the barrel turns 90 degree so [12] will embed into [36],

FIG. 4.

Cylinder shift tunnel and hammer are suggested designs. At the bottom of the cylinder, there is a tunnel which is [46], After shooting, [45] will lift up and go through [46], Since [46] is slanted, the shift will cause the cylinder to rotate automatically when going through the tunnel. Like FIG. 2. said, the cylinder can move in the traditional way of a pistol. That is why this function is optional. No matter which way, the cylinder will move to next position when shooting.

Additional: Alternative to Structure [12]

In this alternative option, [26] is a barrel cover slider that is one closed pipe instead of 2 semi pipes. Instead of structure [12], there will be two side bars along the barrel from the cylinder to where [12] would have been. The side bars serve the same function as [12] which is to latch on to [36], The barrel will still rotate and the spring will be installed in the same way.

Figure 5:
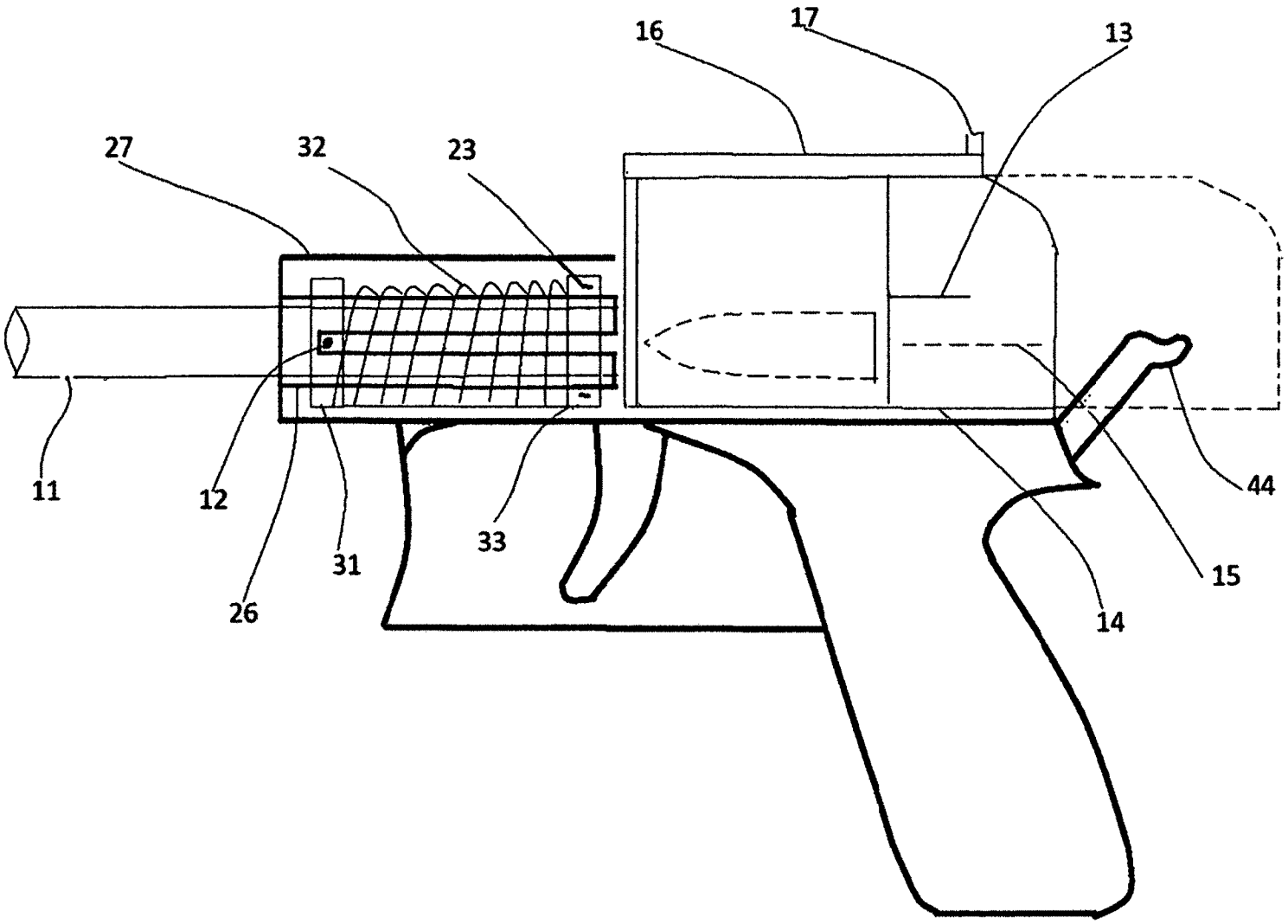
FIG. 5 shows a front view of a sliding revolver pistol in examples of the present disclosure.

Another additional feature is to add oil channels in [26] to make it easier to grease. Front sight can put on [28] or same as cylinder body also. FIG. 5 shows a sliding revolver pistol in examples of the present disclosure. FIG. 5 is an assembly drawing of the components in FIGS. 1, 2, and 3.

The following is a list of reference numbers with corresponding components:

In FIG. 1:

11 Barrel.
12 Barrel spring clutch.
13 Cylinder axis.
14 Barrel slider rod.
15 Pin tunnel.
16 Cylinder holder.
17 Sight.

Figure 2:
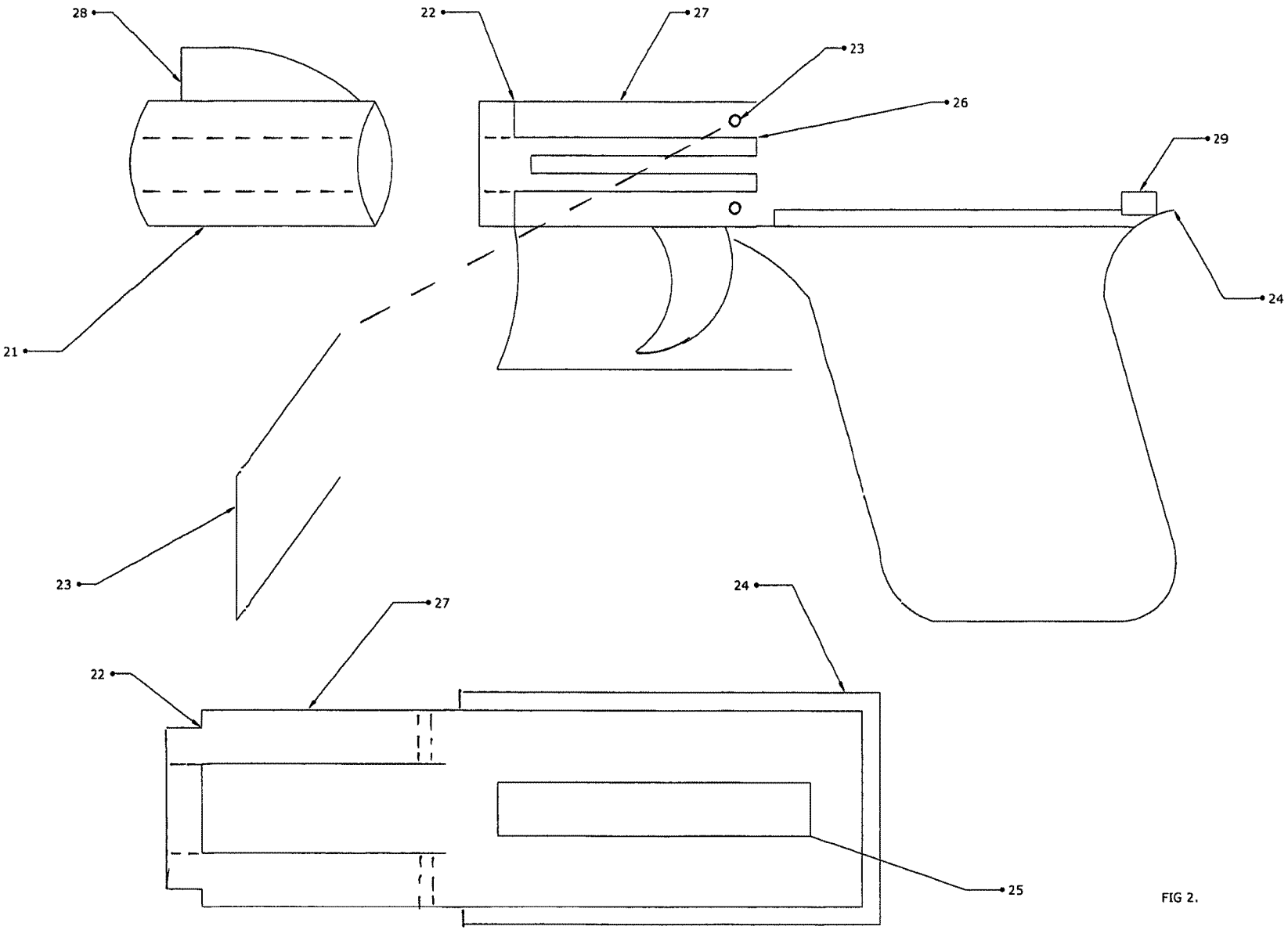
FIG. 2 shows a front view and a top view of a part of a revolver pistol body in examples of the present disclosure.

In FIG. 2:

21 Front barrel cover.
22 Front barrel cover screw connect.
23 Barrel Spring latch.
24 Barrel slider channel.
25 Cylinder step shift window.
26 Semi-tunnel.
27 Barrel spring cover.
28 Front sight.
29 Cylinder holder frame blocker.

Figure 3:
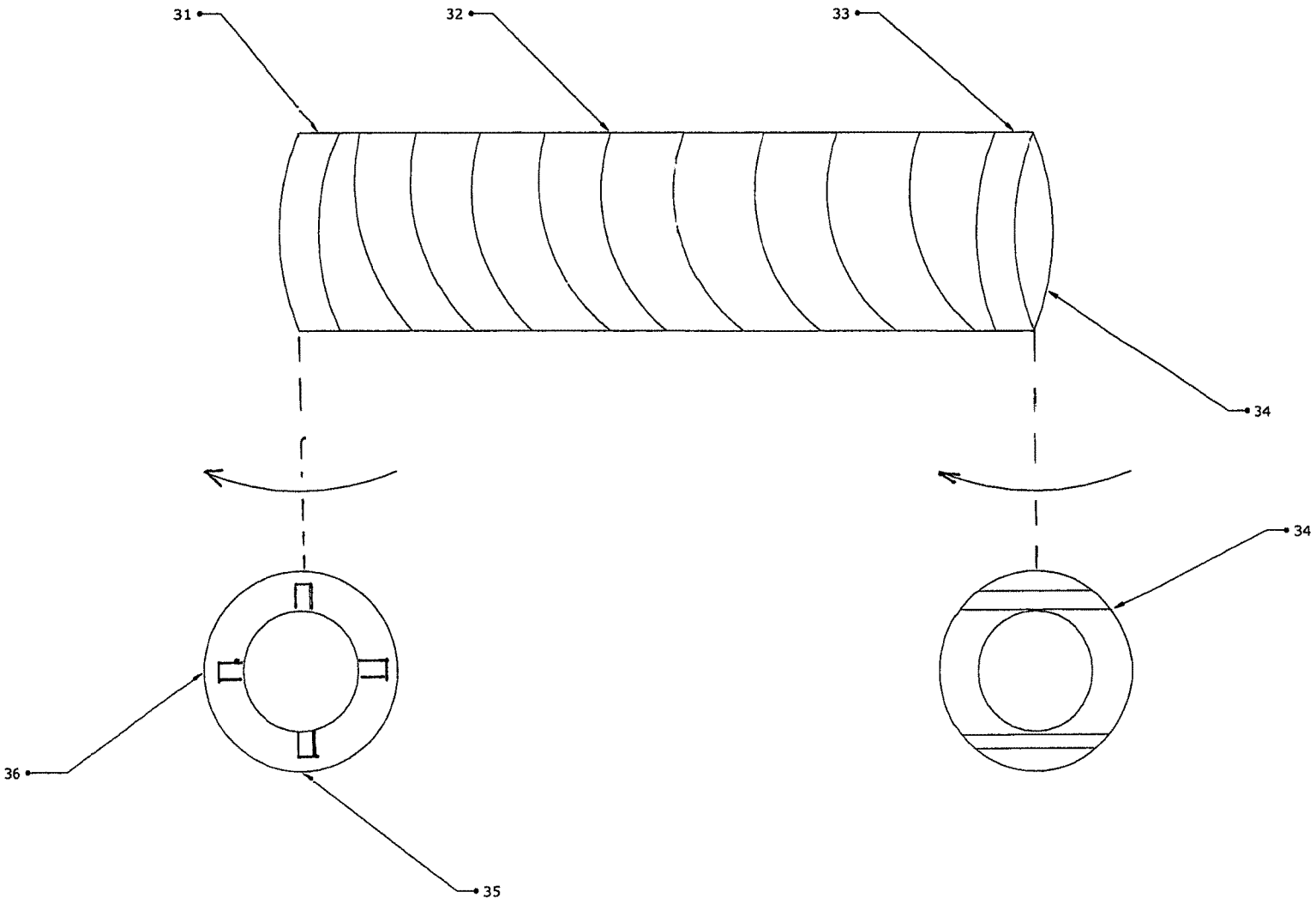
FIG. 3 shows a front view, a right side view and a left side view of a barrel spring in examples of the present disclosure.

In FIG. 3:

31 Barrel spring front end.
32 Barrel spring.
33 Barrel spring back end.
34 Barrel spring latch tunnel.
35 Barrel spring clutch install enter.
36 Barrel spring clutch base.

Figure 4:
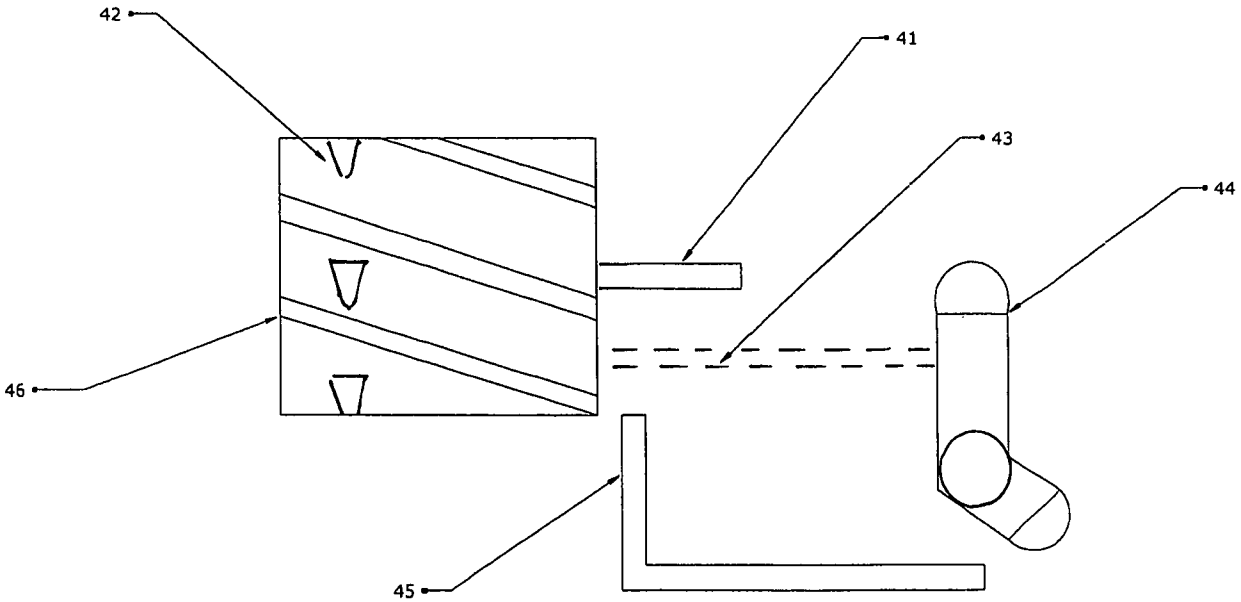
FIG. 4 shows a front view of a cylinder shift tunnel and a hammer in examples of the present disclosure.

In FIG. 4:

41 Cylinder axis.
42 Cylinder position point.
43 Pin Tunnel.
44 Pin hammer.
45 Cylinder step shift.
46 Cylinder shift tunnel.

FIG. 4. Cylinder shift tunnel and hammer. FIG. 5 shows a sliding revolver pistol in examples of the present disclosure.

The invention claimed is:

1. A sliding revolver pistol comprising
a gun base body comprising
a barrel spring cover;
a barrel spring latch attached to the barrel spring cover;
a semi-tunnel;
a barrel slider channel;
a hammer;
a cylinder holder frame blocker;
a cylinder step shift;
a cylinder step shift window configured to allow the cylinder step shift to pass through;
a cylinder shift tunnel;
a trigger; and
a handgrip,
a gun upper body comprising
a barrel is configured to be covered by the semi-tunnel;
a barrel spring clutch attached to the barrel;
a cylinder holder operative with a cylinder;
a barrel slider rod slidable along the barrel slider channel;
a sight;
a cylinder axis; and
a pin tunnel;
barrel slider semi tunnel cover and inside of said barrel spring cover;
a barrel spring clutch base connected to the barrel spring clutch;
a barrel spring latch tunnel configured to accommodate the barrel spring latch; and
a barrel spring disposed in the barrel spring cover;
wherein the cylinder includes a top chamber and a bottom chamber;
wherein the bottom chamber of the cylinder is between the top chamber of the cylinder and the gun base body; and
wherein a centerline of the bottom chamber of the cylinder is aligned with a centerline of the barrel.

2. The sliding revolver pistol of claim 1, wherein the barrel spring surrounds the barrel.

3. The sliding revolver pistol of claim 1, wherein the semi-tunnel covers the barrel so as to allow the barrel to slide back.

4. The sliding revolver pistol of claim 1, wherein the barrel spring clutch operative to pull a front end of the barrel spring backward to reduce recoil of the sliding revolver pistol.

5. The sliding revolver pistol of claim 1, wherein the barrel slider rod allows the cylinder holder to slide backward.

6. The sliding revolver pistol of claim 1, wherein the cylinder axis allows the cylinder to nest inside the cylinder axis.

7. The sliding revolver pistol of claim 1, wherein the pin tunnel allow a pin to move through the pin tunnel.

8. The sliding revolver pistol of claim 1, wherein the barrel spring cover is configured to cover the barrel spring.

9. The sliding revolver pistol of claim 1, wherein the barrel slider channel allows the gun upper body to slide backward.

10. The sliding revolver pistol of claim 1, wherein the barrel spring latch is configured to hold a rear portion of the barrel spring to the gun base body.

11. The sliding revolver pistol of claim 1, wherein the cylinder holder frame blocker is configured to prevent the gun upper body from sliding out of the gun base body when the barrel spring latch fails to hold the barrel spring in place.

12. The sliding revolver pistol of claim 1, wherein the semi-tunnel comprises a plurality of oil tunnel lines and a plurality of holes.

13. The sliding revolver pistol of claim 1, wherein the barrel spring clutch is embedded in the barrel spring clutch base.

14. The sliding revolver pistol of claim 1, wherein the barrel spring latch is inserted through the barrel spring latch tunnel.

15. The sliding revolver pistol of claim 1, wherein the cylinder step shift moves the cylinder to next position.

16. The sliding revolver pistol of claim 1, wherein the cylinder step shift passes through the cylinder step shift window.

17. The sliding revolver pistol of claim 1, wherein the cylinder shift tunnel moves the cylinder to next position.

18. The sliding revolver pistol of claim 1, wherein the front barrel cover covers a front side of the barrel.

* * * * *